US006554281B2

(12) United States Patent
Flannery

(10) Patent No.: US 6,554,281 B2
(45) Date of Patent: Apr. 29, 2003

(54) CASINO GAME

(76) Inventor: Robert Flannery, 4 Redwood, Box 5137, McGregor, Ontario (CA), N0R 1J0

( * ) Notice: Subject to any disclaimer, the term of this patent is extended or adjusted under 35 U.S.C. 154(b) by 0 days.

(21) Appl. No.: 09/745,659

(22) Filed: Dec. 21, 2000

(65) Prior Publication Data

US 2001/0030393 A1 Oct. 18, 2001

Related U.S. Application Data

(60) Provisional application No. 60/173,263, filed on Dec. 28, 1999.

(51) Int. Cl.[7] ..... A63F 3/00

(52) U.S. Cl. ..... 273/274; 273/146; 273/309; 273/292

(58) Field of Search ..... 273/274, 299, 273/146, 292, 309, 142 E, 142 F; 463/17, 18, 19, 20

(56) References Cited

U.S. PATENT DOCUMENTS

| | | | | |
|---|---|---|---|---|
| 4,247,114 | A | | 1/1981 | Carroll |
| 4,312,508 | A | | 1/1982 | Wood |
| 4,334,685 | A | | 6/1982 | Robbins et al. |
| 4,635,938 | A | | 1/1987 | Gray |
| 4,688,803 | A | | 8/1987 | Ollington |
| 4,807,883 | A | | 2/1989 | Silverman |
| 5,133,559 | A | | 7/1992 | Page |
| 5,265,881 | A | | 11/1993 | Doherty |
| 5,308,081 | A | | 5/1994 | Bartle |
| 5,350,175 | A | | 9/1994 | DiLullo et al. |
| 5,505,457 | A | * | 4/1996 | Boylan et al. |
| 5,732,948 | A | | 3/1998 | Yoseloff |
| 5,746,432 | A | * | 5/1998 | Feola |
| 5,775,696 | A | * | 7/1998 | Sidlow et al. |
| 5,791,651 | A | | 8/1998 | Bryant |
| 5,806,847 | A | | 9/1998 | White et al. |
| 5,909,875 | A | * | 6/1999 | Weingardt |
| 5,997,000 | A | * | 12/1999 | Nakano |
| 6,062,563 | A | | 5/2000 | de Keller |
| 6,065,752 | A | * | 5/2000 | Beltran |
| 6,176,489 | B1 | * | 1/2001 | Astaneha |
| 6,273,423 | B1 | * | 8/2001 | Promutico |
| 6,302,395 | B1 | * | 10/2001 | Astaneha |

* cited by examiner

*Primary Examiner*—William M. Pierce

(57) ABSTRACT

A casino game of chance utilizing a pair of dice, a betting surface, and a combination selector. The game is played by wagering on the two sides of the dice which are thrown. A card is drawn from a deck of specialized cards having each of the twenty-one possible side combinations (i.e., 1-1, 3-2, 4-6). The side combination on the card drawn becomes the house side combination. The remaining combinations are available for betting on by the players. Each side combination is associated with a betting area on the playing surface. The betting area may be arranged in pyramids or rectangles to permit betting on multiple combinations. The house number combination is withdrawn from the betting field by extinguishing a light beneath the number or by placing a marker on the betting area. If the player has bet on the side combination rolled, the player then wins according to the payback set forth on the table.

9 Claims, 4 Drawing Sheets

CASINO GAME

This application takes priority on U. S. Provisional Application Ser. No. 60/173,263, filed Dec. 28, 1999.

BACKGROUND OF THE INVENTION

I. Field of the Invention

The present invention relates to casino games and, more particularly, to game tables having betting areas and dice.

II. Description of the Prior Art

Casino games using tables and dice, such as craps, are well known. Many of these games utilize dice and betting areas on which the player makes wagers on the outcome of a roll of the dice. The game of craps presents a number of different betting possibilities including betting on the number rolled, the absence of a particular number from the roll, and a number of other betting possibilities. Although the game is quite popular, the betting schemes are very complex. Many other games using dice are also known.

U.S. Pat. No. 6,062,563 to DeKeller discloses using either six dice or six high cards from a conventional card deck to form a game similar to a poker card game. U.S. Pat. No. 5,265,881 discloses a casino game utilizing either dice or cards in which the player can bet on certain combinations of rolled dice or cards such as pairs and triples. U.S. Pat. No. 4,635,938 discloses a game using a table having betting areas having boxes for betting corresponding to each side of a four sided or tetrahedral shaped dice. However, the betting schemes of these games are complex. Therefore, it is desirable to provide a game of chance which has the excitement of the dice games but is simple to play and is fast and exciting.

SUMMARY OF THE INVENTION

The present invention overcomes the problems of the prior art games by providing a game of chance or a wagering game in which wages are made on which combination of sides of two dice are rolled. Each of the six sides of the dice have different indicias, such as numbers or letters, to indicate the side. Both dice are identical. Thus, there are twenty-one different side combinations available for betting (i.e., 1-1, 1-2, 1-3 . . . 6-6). The betting area contains spaces for betting on each of the side combinations of the roll of the dice. One of the side combinations is designated as the house number combination. The remaining combinations are available for betting on by the player.

The wagering game includes a playing surface with the betting area, the pair of dice and a house number selector. In the preferred embodiment, the house number is selected from a specialized deck of cards, each card having one of the twenty-one side combinations. The spaces of betting area have a pair of indicia which correspond to each of the side combinations. The betting area may be separated into two fields. One field contains the lower probability side combinations which are the doubles such as 1-1, 2-2, 3-3, etc. The second field is directed to the higher probability combinations such as 1-3, 4-6, etc. The betting areas are arranged in such a way that the player may bet on single numbers or a combination of numbers. The winner is determined by which combination is thrown. Thus is provided a simple and easily played wagering game.

BRIEF DESCRIPTION OF THE DRAWINGS

Various other objects, features and intended advantages of the present invention will become more fully appreciated when considered in conjunction with the accompanying drawings in which reference characters designate the same or similar parts throughout the several views, and wherein.

DETAILED DESCRIPTION OF THE PREFERRED EMBODIMENTS

Figure 1:
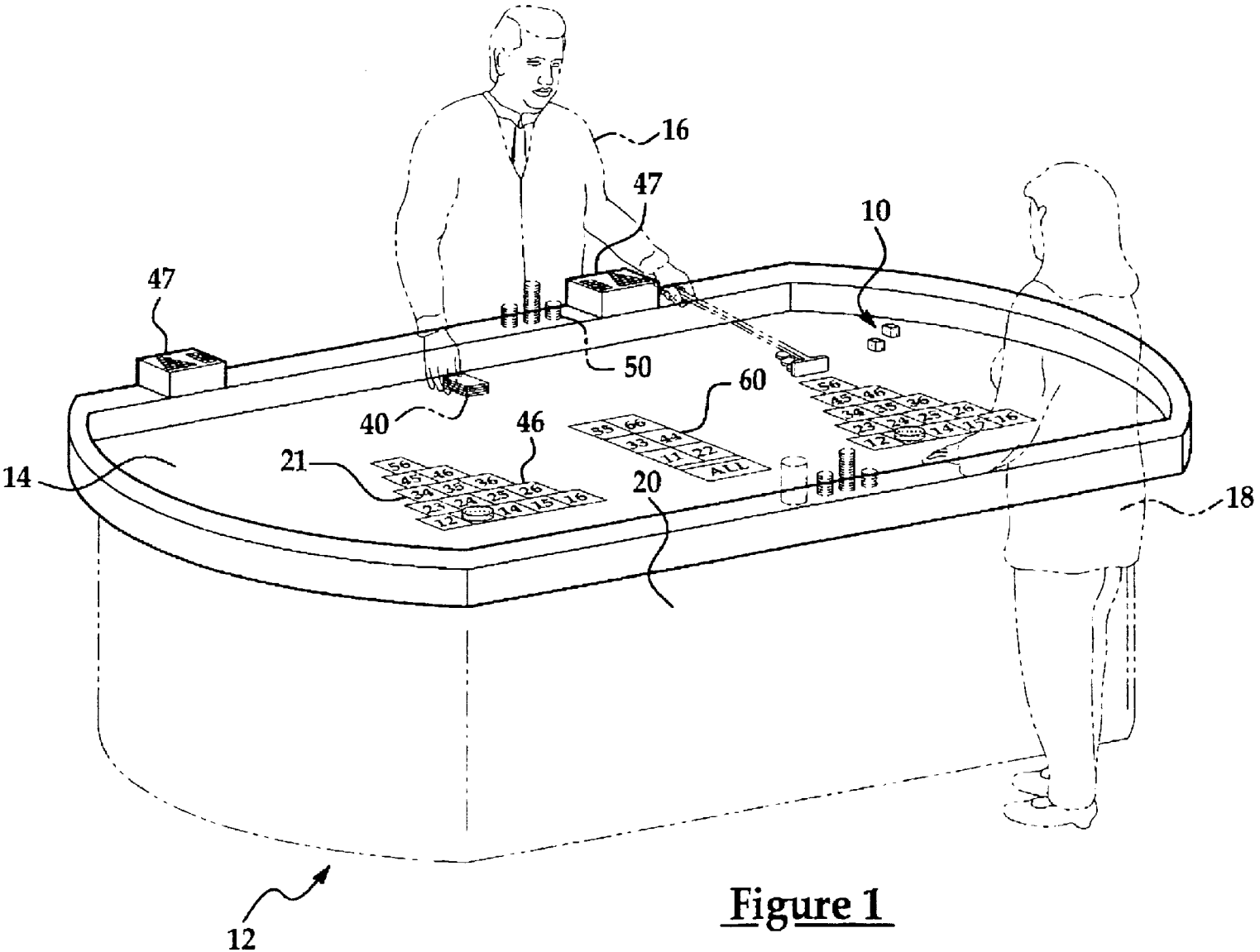
FIG. 1 is a perspective view of a betting table in accordance with the preferred embodiment of the invention.
Figure 2:
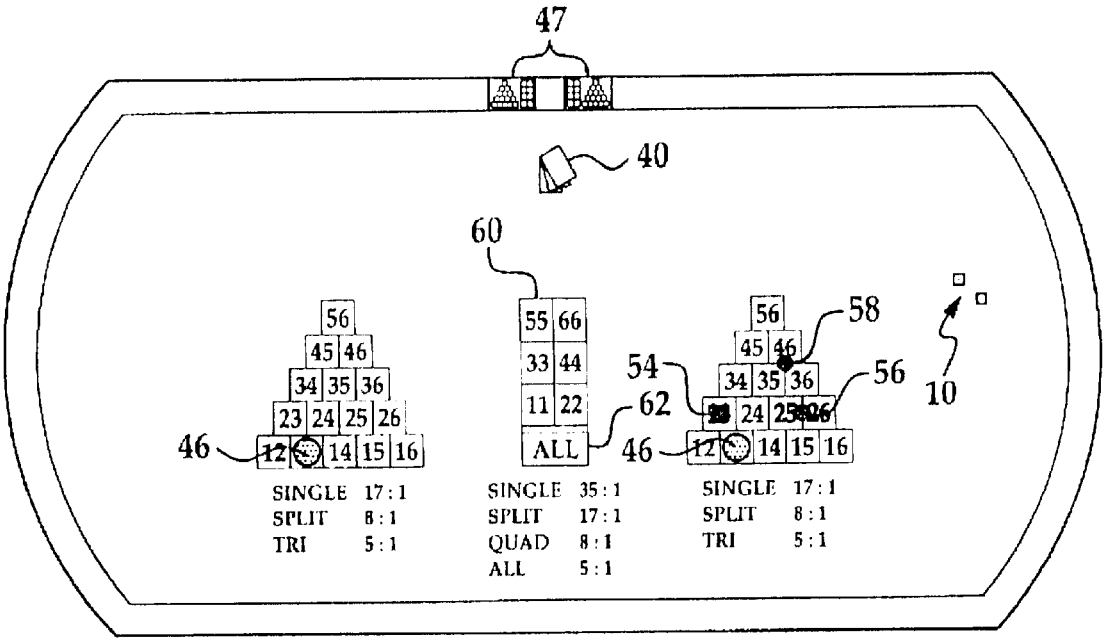
FIG. 2 is a top view of the betting table in accordance with the preferred embodiment of the invention.

A novel game of chance using dice 10 is played on a casino table 12 having a felt playing surface 14 as shown in FIGS. 1 and 2. A croupier 16 is positioned on one side of the table 12 and one player 18 or more stand around the remaining sides of the table 12. The casino table 12 may also be used with two croupiers.

Figure 6:
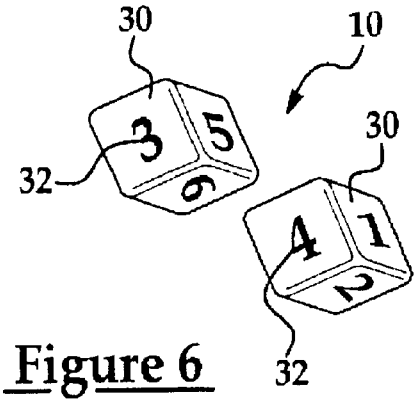
FIG. 6 is a perspective view of a pair of dice in accordance with the preferred embodiment of the invention.
Figure 7:
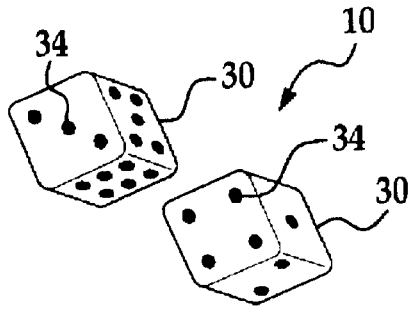
FIG. 7 is a perspective view of a pair of dice in accordance with an alternative embodiment of the invention.

As shown in FIGS. 6 and 7, each of the pair of dice 10 is a six-sided cube. Each side 30 of the dice has one of six different indicia. The two dice 10 are identical. As shown in FIG. 6, the indicia 32 may be numbers (i.e. 1, 2, 4, . . . 6). As shown in FIG. 7, the indicia may be symbols such as pips 34. Alternatively, letters or graphic symbols may be used.

As shown in FIGS. 1 and 2, the playing surface 14 has a betting area 20 having betting spaces 22 stacked in a pyramidal group 24 and a rectangular group 26. Each betting space 22 has a indicia corresponding to one of the side combinations. There are twenty-one possible side combinations. Six of the side combinations are double indicia side combinations where each dice has the same indicia, such as 1-1, 2-2, 3-3, 4-4, 5-5, 6-6. The remaining fifteen side combinations are formed of different indicia, such as 1-2, 1-3, 1-4, 1-05, 1-6, 2-3, 2-4, 2-5, 2-6, 3-4, 3-5, 3-6, 4-5, 4-6, 5-6). The doubles have a lower probability of being rolled and will have a higher payoff than the different indicia side combinations. The betting spaces are separated by lines 28. The pyramidal group 24 has betting spaces 22 containing different indicia side combinations. The rectangular group 26 of betting spaces 22 contains the double indicia side combinations.

The game also includes a house side combination selector. In the preferred embodiment, the selector includes a deck of specialized cards 40. Each card has a pair of indicia 42 corresponding to the twenty-one possible side combinations. Alternatively, the selector may be an electronic device (not shown). The electronic device is selectively operable to randomly select two corresponding indicia corresponding to one of the betting combinations and has a display for displaying the house side combination. The probability may be changed by selecting two or more house side combinations or changing the proportion of single indicia side combination cards to double side indicia side combinations. Thus, the deck could be comprised of one set of double indicia side combinations (six cards) and two sets of single indicia side combinations (thirty cards).

Figure 3:
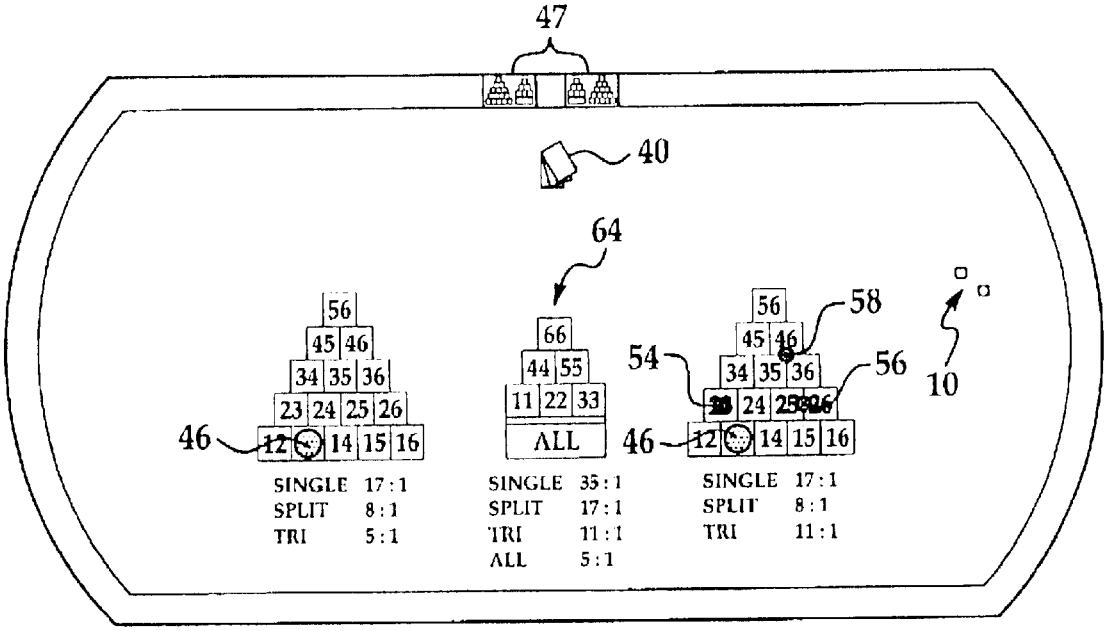
FIG. 3 is a top view of a first preferred alternative embodiment of a table having betting areas in accordance with the invention.

As shown in FIG. 1, the game also includes a house side combination indicator 44 for the betting spaces 22. In the preferred embodiment, each betting space 22 of the betting area 20 is formed on a sheet of translucent material and has a light beneath the playing surface to separately illuminate each betting space. A panel of switches 47 is located near the croupier 16. After the house side combination is selected, a switch is activated to illuminate the betting space containing the house side combination as shown at 46 or to occlude the house side combination in the event all of the betting spaces are illuminated as shown in FIG. 3.

An alternative house side combination indicator is a marker 48, such as a large disc, which is positioned on the betting space 22 corresponding to the house side combination thereby indicating that the house number combination is not available for betting. Finally, the game includes the use of conventional poker chips 50 or tokens for use in making bets.

Method of Play

Figure 4:
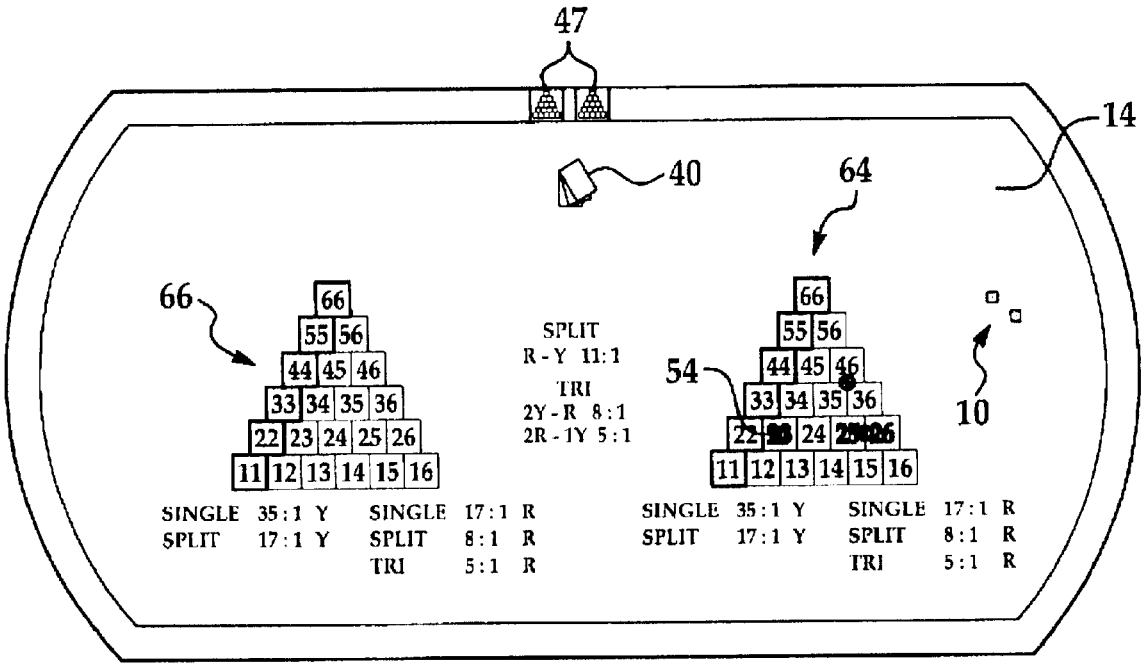
FIG. 4 is a second alternative arrangement of the betting areas in accordance with the invention.
Figure 8:
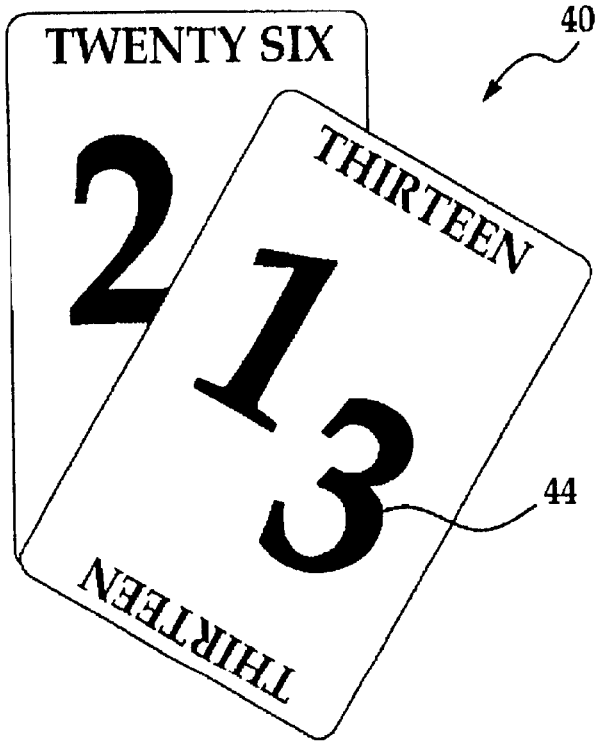
FIG. 8 is a top view of a pair of cards used in accordance with the preferred embodiment of the invention.

The game is played by first selecting a house side combination. When using the deck of cards 40, the cards are shuffled and the croupier turns the top card over to display a side of the card with the indicia. In a casino, a device may be used to shuffle the cards. The croupier then removes the house number from the betting area by illuminating or extinguishing the light beneath the betting space having the same indicia as the card. As shown in FIG. 8, the top card shows the indicia 1-3. In FIG. 2, the house number combination 1-3 is illuminated at 46. Alternatively, the marker 48 is placed over the house number combination 1-3 as shown in FIG. 4. The players then make bets by placing chips 50 or tokens on a betting space 22 or line 28.

In the preferred embodiment such as shown in FIG. 2, the player may select a single combination by placing a chip 54 entirely within a space in one of the two fields, for instance space 2-3, as shown in FIG. 2. As illustrated under the pyramidal group 24, the payback for a bet on a single betting space is seventeen to one in the higher probability combinations. Alternatively, the player may make a split bet by placing a chip 56 on the line 28 between two betting spaces such as indicated in FIG. 2 on the line 28 between spaces 2-5 and 2-6. In this case, the payback is eight to one. The better can also make a tri-bet by placing a chip 58 on a corner of three betting spaces such as shown in FIG. 2 in the spaces 4-6, 3-5, and 3-6. The payback for this bet is five to one. Alternatively, the player may select one of the combinations from the rectangular group by placing a chip 60 on the betting space 5-5. The payback for a single bet in the rectangular group 26 is thirty-five to one. A split bet payback is seventeen to one, and a quad-bet payback is eight to one. The betting area may include a betting space 62 entitled "all" which permits the player to bet on all of the betting spaces in a group.

One of the players then rolls the dice 10 and the two indicia on the top of the dice are then used to determine the winning combination. If the combination is the house side combination, then the house wins the game. If the winning number has been bet on by one or more of the players, then the player is paid according to the payback associated with the type of bet made by the player. Once the bet has been paid, the game may be played again by selecting a new house side combination and rolling the dice 10.

Figure 5:
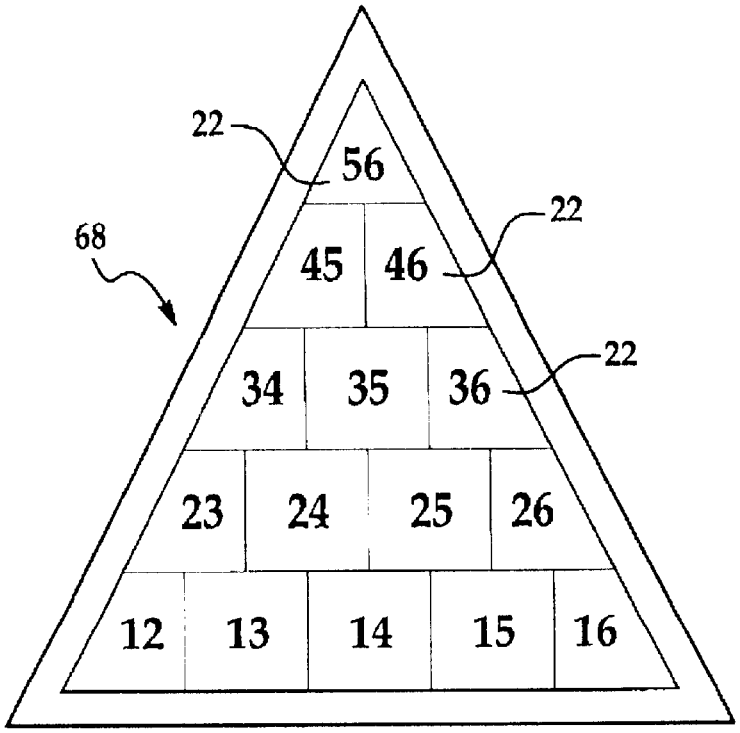
FIG. 5 is an alternative arrangement of a betting field in accordance with the invention.

As shown in FIG. 3, the shape and arrangement of the betting areas 22 can be altered to change the type of bets made. In FIG. 3 a triangular arrangement 64 is used rather than a rectangle for the higher payback combinations. In FIG. 4, both the double side combinations and single side combinations are combined into one pyramid 66 with the single side combinations in yellow ("y") and stepped upwardly on the left-hand side of the pyramid 66. The single side combinations are in red ("r"). As shown in FIG. 5, betting spaces 22 can be of varying shapes and arranged in various manners such as a pyramid 68.

Although the game above has been described in reference to a casino game, it is also within the spirit of the invention to present the game as a board game. The betting areas are printed on a board and a disc is used to indicate the house number as discussed above. Cards and dice as described above are also provided and the game is played in exactly the same fashion as described. It is to be understood that the embodiments discussed herein are merely illustrative of the application of the principles of the invention. Numerous modifications may be made therein and other arrangements may be devised without departing from the spirit and scope of the invention. The game may be utilized as a carnival game or home parlor game rather than a casino game. Accordingly, it is not intended that the invention be limited except as set forth in the appended claims.

I claim:

1. A game of chance comprising:

a pair of dice, each of said pair of dice having six sides, each of said six sides having a different indicia from a set of six indicia;

a house combination selector for determining a pair of indicia from said set of six indicia, said house combination selector including a deck of cards, each card of said deck of cards having a side having a pair of indicia selected from said set of six indicia;

a playing surface having a betting area having a plurality of betting spaces, each of said spaces having a pair of indicia selected from said set of six indicia;

a house number indicator for indicating one betting space of said plurality of betting spaces on said playing surface, said one betting space having a pair of indicia corresponding to said pair of indicia selected by said house number combination selector; and at least one token for placement on at least one of said betting spaces.

2. The game of claim 1, wherein said plurality of betting surfaces comprises two groups of betting spaces, a higher payback group of betting spaces having pairs of indicia which are alike, and a lower payback group having a pair of indicia from said set of six indicia which are different.

3. The game of claim 1, wherein said house number indicator is a marker having a flat surface for placement on one of said plurality of betting spaces.

4. The game of claim 1, wherein each of said betting spaces is formed of a translucent material and said house number indicator includes a plurality of lights, each light of said plurality of lights corresponding with a respective one of said betting spaces to selectively illuminate said plurality of betting spaces.

5. A game of chance comprising:

a pair of dice, each of said pair of dice having six sides each of said six sides having a different indicia from a set of six indicia;

a house combination selector for determining a house combination, said house combination including a pair of indicia from said set of six indicia;

a playing surface having a betting area having a plurality of betting spaces, each of said betting spaces having a pair of indicia from said set of six indicia such that all pairs of indicia of said set of six indicia are represented on at least one betting space;

a house number indicator for indicating one betting space of said plurality of betting spaces on said playing surface, said one betting space having a pair of indicia corresponding to said pair of indicia selected by said house number combination selector; and at least one token for placement on at least one of said betting spaces.

6. The game of claim 5, wherein said house combination selector includes an electronic device for randomly selecting and displaying house number combinations.

7. A method of playing a game of chance comprising:

selecting a house combination having two indicia from a set of six indicia;

forming a betting area having a plurality of betting spaces, each betting space having a pair of indicia from said set of six indicia, such that all combinations of two indicia of said set of six indicia is represented on at least one of said plurality of spaces;

designating at least one of said plurality of betting spaces as corresponding to said house combination;

waging on the outcome of a roll of dice by a bettor on one or more spaces of said plurality of betting spaces which are not designated as a house number combination;

rolling a pair of dice, each of said dice having six sides, each of said six sides having a different indicia from said set of six indicia; and determining the outcome of the wager by matching the combination of indicia appearing on upwardly facing sides of said pair of dice with a pair of indicia in one of said plurality of betting spaces.

8. A method of playing a game of chance comprising:

selecting a house combination from a house number selector, said house number selector including a deck of cards, each of said cards having a side having a pair of indicia selected from said set of six indicia;

forming a betting area having a plurality of betting spaces, each space having a pair of indicia from said set of six indicia, such that all combinations of two indicia of said set of six indicia is represented on at least one of said plurality of spaces;

designating at least one of said plurality of betting spaces as corresponding to said house combination;

waging on the outcome of a roll of dice by a bettor on one or more spaces of said plurality of betting spaces which are not designated as a house number combination;

rolling a pair of dice, each of said dice having six sides, each of said six sides having a different indicia from said set of six indicia; and determining the outcome of the wager from the combination of indicia appearing on upwardly facing sides of said pair of dice.

9. A method of playing a game of chance comprising:

selecting a house combination having a pair of indicia from a set of six indicia;

forming a betting area having a plurality of betting spaces, each betting space of said plurality of betting spaces having a pair of indicia from said set of six indicia, such that all pairs of indicia of said set of six indicia is represented on at least one betting space;

designating at least one of said plurality of betting spaces as corresponding to said house combination;

waging on the outcome of a selection of a pair of indicia by placing a bet on one or more betting spaces that are not designated as a house number combination;

selecting a pair of indicia from said set of six indicia;

determining the outcome of the wager by matching the selected pair of indicia with a pair of indicia in one betting space.

* * * * *